US006705902B1

(12) United States Patent
Yi et al.

(10) Patent No.: US 6,705,902 B1
(45) Date of Patent: Mar. 16, 2004

(54) CONNECTOR ASSEMBLY HAVING CONTACTS WITH UNIFORM ELECTRICAL PROPERTY OF RESISTANCE

(75) Inventors: Chong H. Yi, Mechanicsburg, PA (US); Jared J. Smalley, Jr., Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/309,486

(22) Filed: Dec. 3, 2002

(51) Int. Cl.[7] ..... H01R 13/64
(52) U.S. Cl. ..... 439/678
(58) Field of Search ..... 439/79, 80, 65, 439/101, 607, 678

(56) References Cited

U.S. PATENT DOCUMENTS

| | | | | |
|---|---|---|---|---|
| 2,430,011 A | * | 11/1947 | Gillentine | 439/160 |
| 4,167,299 A | * | 9/1979 | Noguchi | 439/586 |
| 4,975,069 A | * | 12/1990 | Fedder et al. | 439/101 |
| 5,174,764 A | * | 12/1992 | Kandybowski et al. | 439/83 |
| 5,533,915 A | * | 7/1996 | Deans | 439/678 |
| 6,368,121 B1 | * | 4/2002 | Ueno et al. | 439/108 |
| 6,431,886 B1 | * | 8/2002 | Ramey et al. | 439/101 |
| 6,443,740 B1 | * | 9/2002 | Evans | 439/63 |

FOREIGN PATENT DOCUMENTS

| | | | | |
|---|---|---|---|---|
| GB | 1029090 | * | 5/1933 | 439/677 |

* cited by examiner

*Primary Examiner*—Neil Abrams
*Assistant Examiner*—Thanh-Tam Le
(74) *Attorney, Agent, or Firm*—Wei Te Chung

(57) ABSTRACT

A connector assembly (1) to usually form a power part of a backplane connector assembly comprises an electrical connector (2) and a mating complementary connector (3). The connector (2) has an insulated housing (20) and a plurality of power conductors (21) installed inside the housing (20), and the complementary connector (3) has an insulated housing (30) and a plurality of complementary conductors (31, 32) installed inside the housing (30). At least one conductor (23) of the connector (2) and its complementary conductor (32) of the complementary connector (3) are arranged beside other conductors (22, 31) while other conductors (22) of the connector (2) and other complementary conductors (31) are arranged in the same rows respectively. Controllable electrical property and maximum current carrying capacity of the conductors in the connector assembly is easily acquired due to the specially arranged conductors. And the size of the connector assembly can be compact to meet the need of structural simplification and become easier to be assembled with other backplane connector parts.

7 Claims, 5 Drawing Sheets

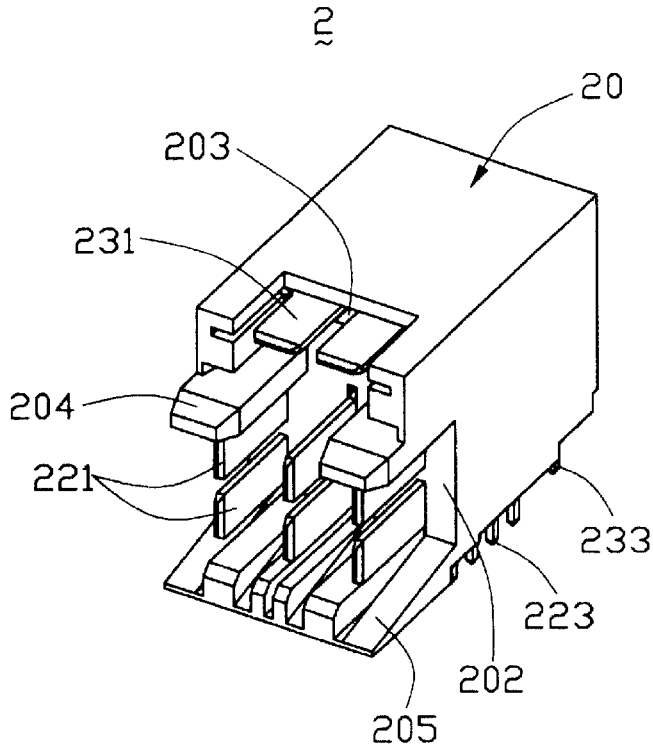
FIG. 2
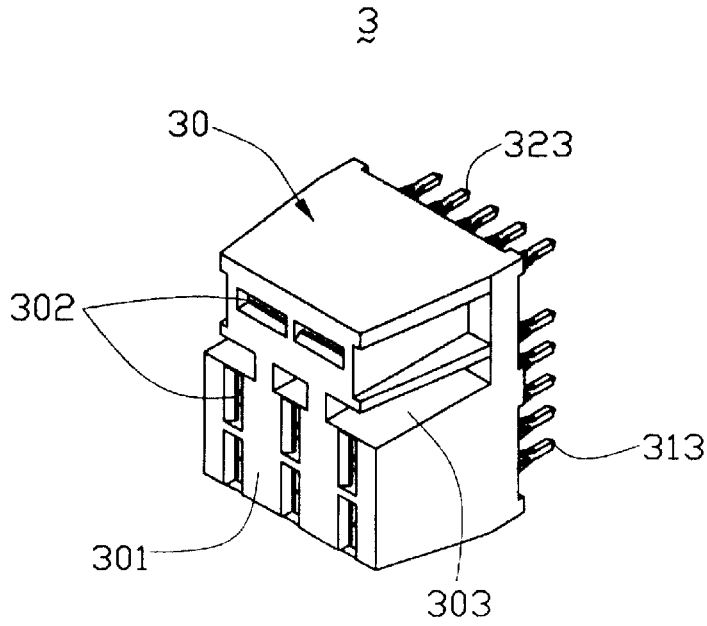
FGI. 4

CONNECTOR ASSEMBLY HAVING CONTACTS WITH UNIFORM ELECTRICAL PROPERTY OF RESISTANCE

BACKGROUND OF THE INVENTION

1. Field of the Invention

The present invention is related to a connector assembly functioning as power parts of a corresponding backplane connector assembly, especially to a connector assembly having a special power contact arrangement to get balanced and steady current transmission beside the backplane connector assembly which is used to connect with a daughtercard and a backplane or motherboard.

2. Description of the Related Art

Many present day telecommunications systems, computer systems, etc. include a number of printed circuit boards or cards which plug into a backplane or motherboard of the systems to enhance or complete performances of the systems. The backplane or motherboard generally provides a pathway by which the printed circuit boards or cards communicate with each other. In addition, the backplane provides power as well as a reference voltage or ground to each of the printed circuit boards. Conventionally, the parts for power or ground are arranged right beside or around the signal contacts of a backplane connector as attachments of this connector, as shown in Johnson et al. U.S. Pat. No. 4,655,518, Madore et al. U.S. Pat. No. 4,973,260, Buchter U.S. Pat. No. 5,582,519 and Lemke et al. U.S. Pat. No. 6,325,644. Usually different locations or structures for the power or ground parts inside the backplane connector are considered to function in their own ways for specialized performances like EMI shielding, crosstalk suppressing, power supply, etc. For the power application, high current setting is unpractical and undesired for these conventional connectors due to possible noise induced in the neighboring signal contacts by high current through the power parts. And trend of high density contact arrangement and minimization of electronic parts results in much difficulty of manufacturing connectors due to less available space for the installation of power or ground parts without affecting the normal function of signal contacts.

Therefore, independent, modularized power parts are considered to adopt to solve the minimization and noise problem in the arts. As introduced in Weber et al. U.S. Pat. No. 4,790,763, Weber U.S. Pat. No. 4,818,237, Fedder et al. U.S. Pat. No. 5,158,471 and Provencher U.S. Pat. No. 5,360,349, modularized power parts being able to programmably latch on signal contact parts are disposed next to the signal contact parts to form corporately with the signal contact parts a complete backplane connector. Alternately, Demler et al. U.S. Pat. No. 4,881,905, Barkus et al. U.S. Pat. No. 5,139,426 and Clark et al. U.S. Pat. No. 6,319,075 all show an independent power connector mounted at different location from the one of the signal connector on the backplane or daughtercard. Obviously, additional space on the backplane and daughtercard must be reserved for extra power parts and independent power connectors. More manufacturing processes are needed to make the parts or connectors, and sometimes the extra processes cost high.

Besides, as shown in the '075 patent of Clark et al., all of the contacts of the power connector are arranged in a row along the lengthwise direction of the connector housing so that the contacts are positioned vertically, and the direction is usually parallel to the surface of a printed circuit board when the power connector is seated on the printed circuit board. For a power connector with a large number of contacts, the size of the power connector is enlarged to accept all of the parallel-arranged contacts. Obviously the enlarged power connector is sometimes occupied more room than being expected, and the manufacturing process of the connector becomes complex too. Therefore, another thought for designing the connector is trying to place the contacts as a horizontal row along the direction perpendicular to the printed circuit board so that the contacts look like stacking vertically with each other. The different thought is helpful for the connector design due to the feature of space-saving and size-minimizing. However, the stacked arrangement of contacts varies the shape of contacts due to their installed positions. Obviously the top contact stacked highest is longer than the bottom contact because the distance between the installed position of the top contact and the printed circuit board where the connector is seated is farthest. The result of difference lengths of contacts causes different bulk resistance for each contact, which lowers the current rating through contacts with high resistance and induces the difficulty of circuitry designing.

SUMMARY OF THE INVENTION

Therefore, an object of the present invention is to provide a power connector assembly having plug and receptacle parts with uniform electrical properties like resistance in order to achieve stable electrical performance for safety of the circuitry of printed circuit boards where component connectors of the connector assembly are mounted.

Another object of the present invention is to provide a power connector assembly having a compact part arrangement to assemble its parts in order to minimize its component connectors and the final backplane connector assembly with signal connector parts.

Another object of the present invention is to provide a power connector assembly having an idealized distribution of power current density per unit area on the mating faces of mated connectors of the connector assembly to get the maximum current carrying capacity and facilitate assembling of the power connector assembly with other signal ones.

To obtain the above objects, a connector assembly in accordance with the present invention includes a plug connector and a receptacle connector mated with the plug connector. The plug connector has a housing with a plurality of passageways to receive the same number of plug conductors. Each plug conductor has a contacting portion extending out of the housing, a retention portion staying in the housing to fix the conductor therein, and a tail portion extending out of another side of the housing to further connect to a printed circuit board. Meanwhile, the receptacle connector has a complementary housing with a plurality of passageways to receive the same number of receptacle conductors configured to mate with the plug conductors. Each receptacle conductor has a contacting portion installed in its corresponding passageway, a retention portion next to the contacting portion to fix the conductor in the passageway, and a tail portion extending out of the housing to further connect to another printed circuit board.

Specially, most of conductors of the plug and receptacle connector are arranged in a row along a first direction parallel to printed circuit boards where the connectors are seated respectively. And at least one conductor of the plug or receptacle connector is located beside others and arranged along a second direction perpendicular to the first direction. Controllable electrical property and maximum current carrying capacity of the conductors in the connector assembly is easily acquired due to the specially arranged conductors. And the size of the connector assembly can be compact to meet the need of structural simplification and become easier to be assembled with other backplane connector parts.

Other objects, advantages and novel features of the invention will become more apparent from the following detailed description of the present embodiment when taken in conjunction with the accompanying drawings.

BRIEF DESCRIPTION OF THE DRAWINGS

FIG. 2 is a perspective view of the electrical connector as shown in FIG. 1 in accordance with the present invention;

FIG. 4 is a perspective view of the mating complementary connector as shown in FIG. 1 in accordance with the present invention;

DESCRIPTION OF THE PREFERRED EMBODIMENT

Figure 1:
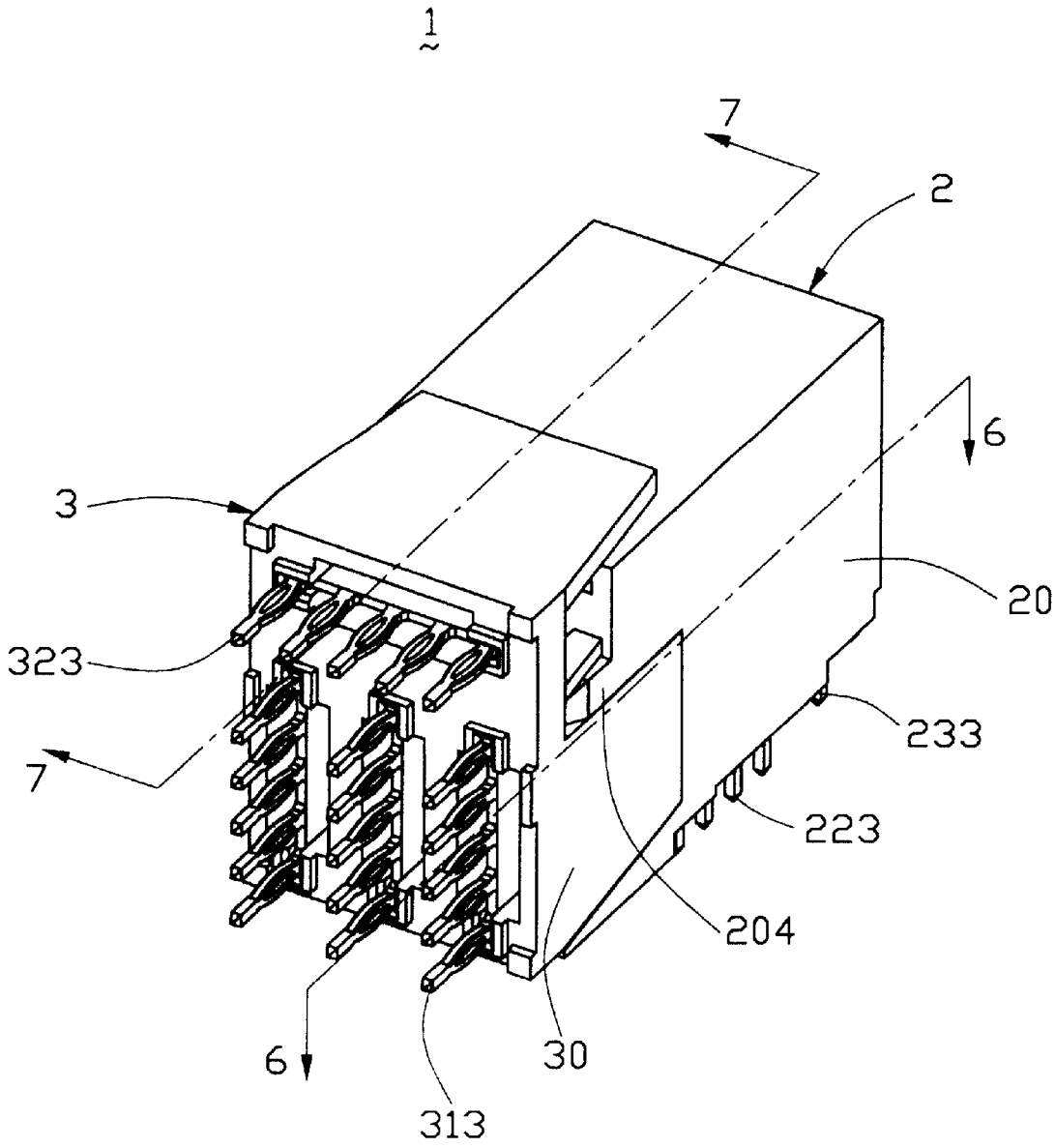
FIG. 1 is a perspective view of an electrical connector and its mating complementary connector of a connector assembly in accordance with the present invention.
Figure 3:
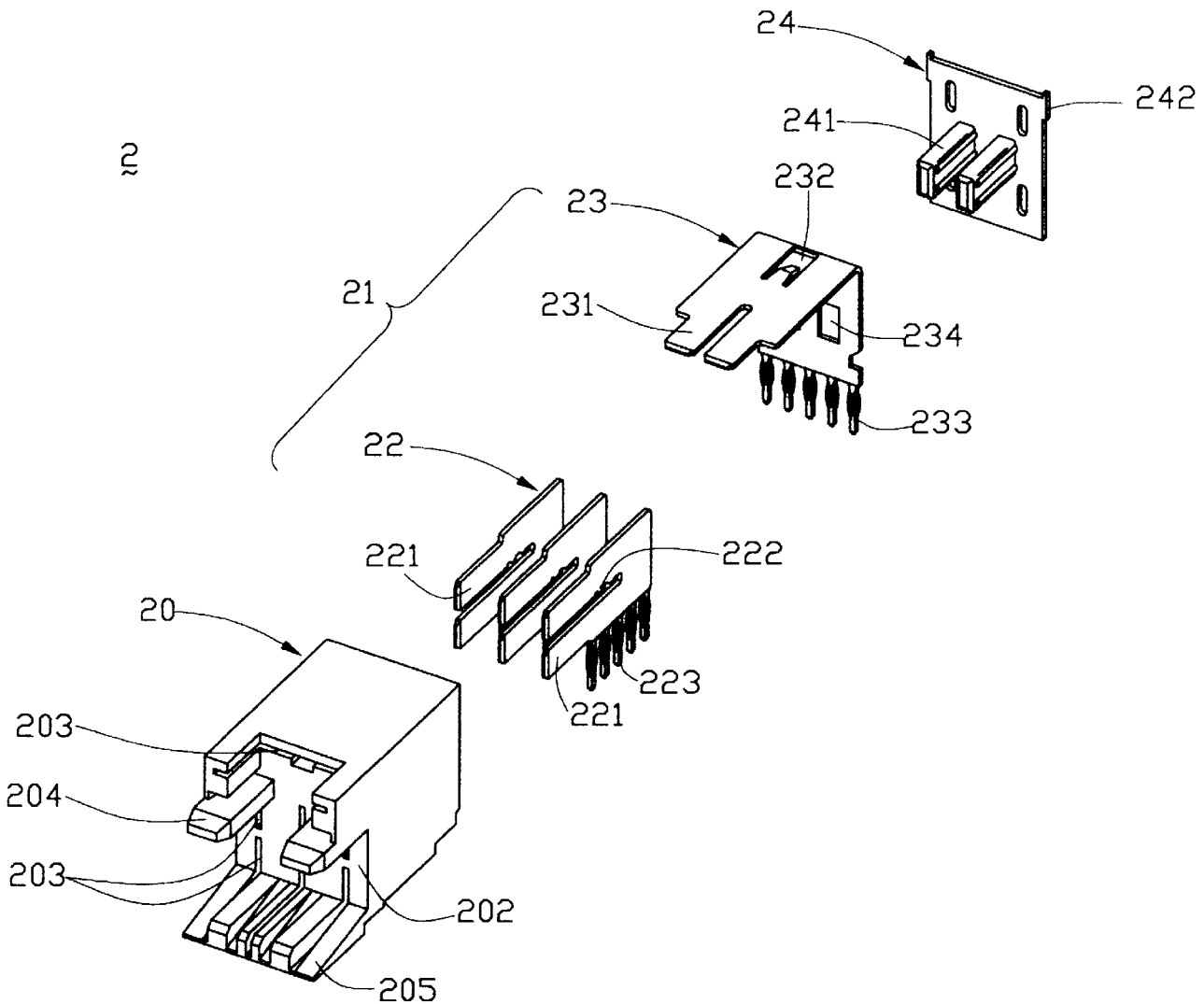
FIG. 3 is an explored view of the electrical connector as shown in FIG. 2 in accordance with the present invention.
Figure 6:
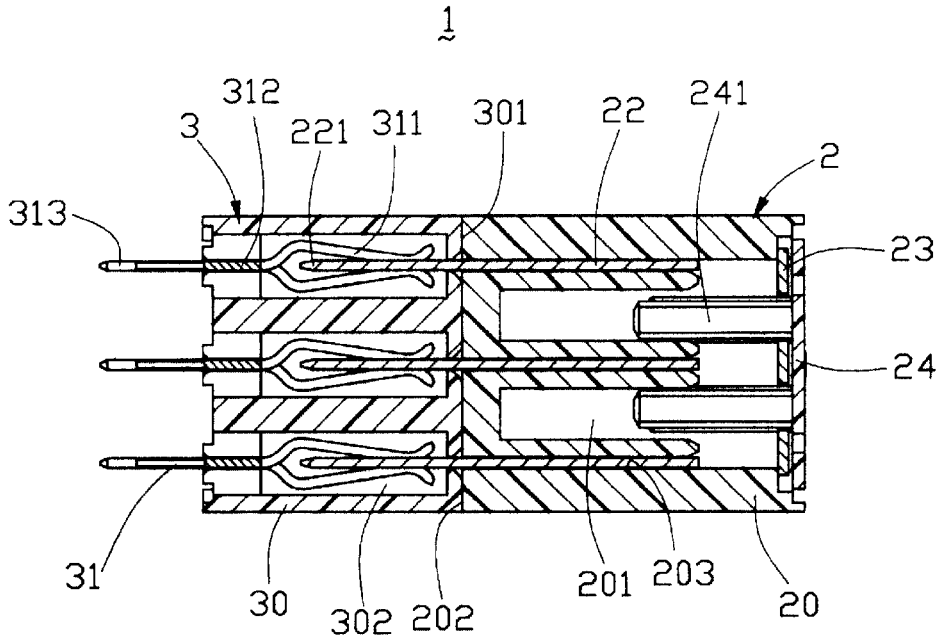
FIG. 6 is a sectional view of the electrical connector and its complementary connector showing the mating situation along the 6—6 line in FIG. 1.
Figure 7:
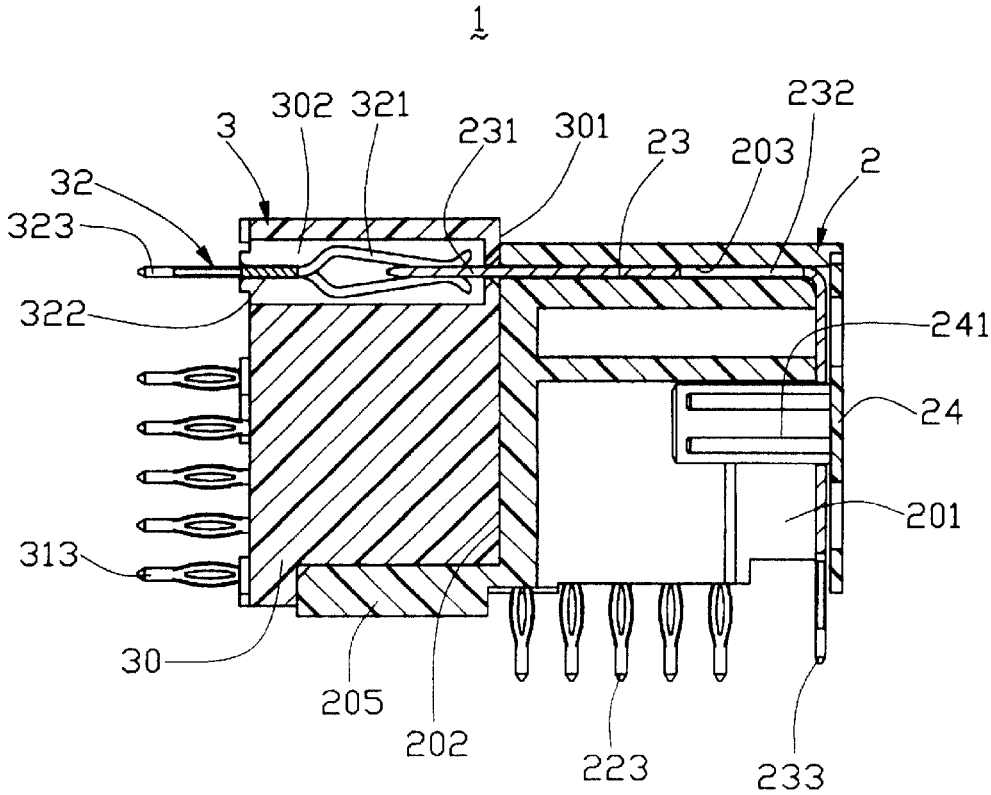
FIG. 7 is a sectional view of the electrical connector and its complementary connector showing the mating situation along the 7—7 line in FIG. 1.

Referring to FIGS. 1 to 3, the electrical connector 2 in accordance with the present invention is shown mating with its complementary connector 3 to form a connector assembly 1. The plug type electrical connector 2 as shown in FIG. 2 includes an insulated housing 20 and a plurality of power conductors 21 installed inside the housing 20. A receiving space 201 (as shown in FIG. 6 or 7) is formed in the housing 20 and a mating face 202 is formed on one outer side of the housing 20 beside the space 201. A plurality of passageways 203, each of them is used to receive portions of every conductor 21 correspondingly, is formed on the mating face 202 and extends through the mating face 202 to communicate with the receiving space 201 of the housing 20. Most of these passageways 203 are arranged vertically in a row along a first direction parallel to a printed circuit board (not shown) where the plug connector 2 is seated. But at least one passageway 203 is located beside others and arranged along a second direction perpendicular to the first direction. Two guide posts 204 protrude from the mating face 202 and are located abutting against two opposing edges of the mating face 202. A sidewall 205 with several guiding ribs formed thereon projects from the mating face 202 as well and extends from another edge of the mating face 202. Besides, a rear part 24 as a plastic plane-like piece is disposed at the back of the housing 20. Two upright posts 241 with retention ribs formed thereon extend from the central area of the rear part 24, and two engaging portions 242 are formed at two neighboring corners of the rear part 24 in order to fasten the rear part 24 onto the housing 20.

Power conductors 21 includes several first conductors 22 and at least one second conductor 23. Each first conductor 22 is arranged as an upright metal plate before it is installed into the corresponding passageway 203 and fixed therein by passing through the receiving space 201 from the back of the housing 20. At least two contacting portions 221 extend from the main body of every first conductor 22 with a slot formed therebetween. At the end of the slot, a retention portion 222 having several barbs is formed in order to engage with an inner wall inside the passageway 203 where the first conductor 22 is installed and to fix the first conductor 22 therein. Tail portions 223, extending vertically from one edge of the body of every first conductor 22, are arranged in a row along the edge. The second conductor 23, on the contrary, is an L-shaped metal plate having two extending contacting portions 231 formed at its one end and several tail portions 233 formed at the other end. A severed window-like retention portion 232 having a resilient arm formed therein is disposed next to the contacting portions 231 on the top plate section of the second conductor 23 so that the resilient arm of the retention portion 232 can engage with inner sidewalls of the passageway 203 where the second conductor 23 is going to be installed in order to fix the second conductor 23 therein. And at least two openings 234 are formed on the lateral plate section of the second conductor 23. Either the first or second conductor 22, 23 is inserted into the housing 20 through the receiving space 201 from the back of the housing 20, and is fixed inside its corresponding passageway 203 by its own retention portion 222, 232. The contacting portion 221, 231 of every conductor 21 then extends beyond the mating face 202 of the housing 20 beside the guide posts 204 when the conductors 21 are fully inserted. Afterwards, the rear part 24 is mounted onto the housing 20 with its two posts 241 fixedly penetrating through the corresponding openings 234 of the second conductor 23 respectively to position the rear half of the second conductor 23.

Figure 5:
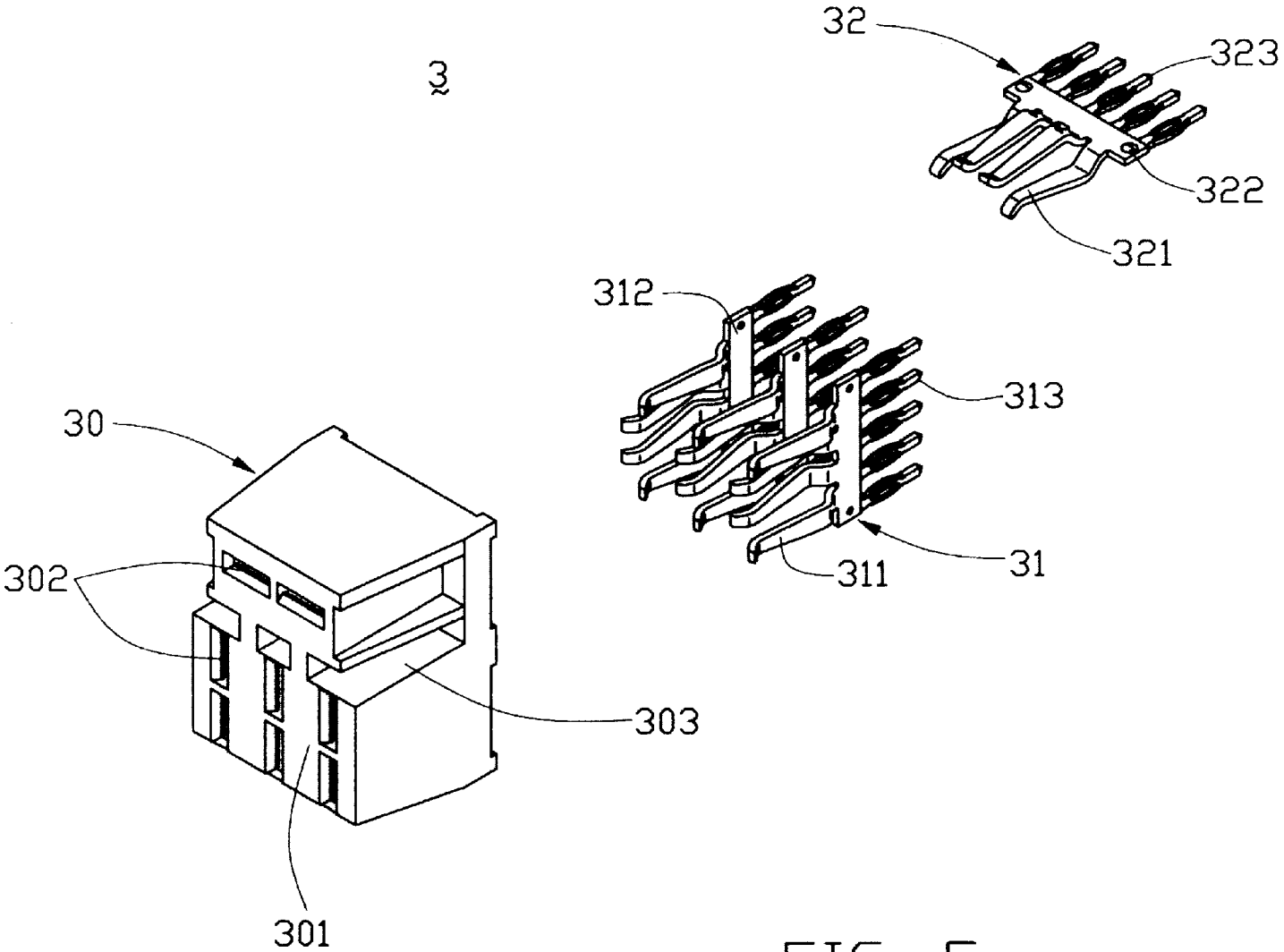
FIG. 5 is an explored view of the mating complementary electrical connector as shown in FIG. 4 in accordance with the present invention.

Referring particularly to FIGS. 4 and 5, the mating complementary connector 3 of the connector assembly 1 includes an receptacle-typed housing 30 and a plurality of power conductors 31, 32 installed therein. The housing 30 adapted to mate with the plug connector 2 comprises a mating face 301 formed on its one side and a plurality of passageways 302 extending inside the housing 30 from the mating face 301 to the face opposing to the mating face 301. Some of the passageways 302 are arranged in a row by locating every passageway 302 in one plane of a group of imaginary planes parallel to each other, and at least one passageway 302 is located beside the passageway row by locating the at least one passageway 302 in an imaginary plane basically perpendicular to any of the former parallel imaginary planes. Two channels 303 are respectively located on two opposite surfaces with a predetermined extending length on the surfaces neighboring the mating face 301 and both have a communicating opening on the mating face 301.

The power conductors installed in the receptacle housing 30 includes several first conductors 31 and at least one second conductor 32. Each first conductor 31 has a plate-like retention portion 312 with several retention dot protrusions formed thereon. Several tail portions 313 extend from one side of the retention portion 312 and are arranged in one row. Pairs of resilient contacting portions 311 extend from another side of the retention potion 312 along a direction opposing to the extending direction of tail portions 313 while each contacting portion 311 of the same pair is bent away from each other to form a fork-like mating portion. Each first conductor 31 is installed in its corresponding passageway 302 arranged in the same row to have its contacting portions 311 staying therein. The second conductor 32 is basically identical to any of the first conductors 31 except the second conductor 32 is installed in the at least one passageway 302 arranged differently from others. Therefore the second conductor 32 has a contacting portion 321, a retention portion 322 and several tail portions 323 and all of them are configured same as the first conductors 31.

Referring to FIGS. 1, 6 and 7, it is understandable, when the electrical connector 2 and its complementary connector 3 of the connector assembly 1 is going to be mated, the guide posts 204 of the plug connector 2 is first inserted into the channels 303 of the receptacle connector 3 to guide these two connectors 2, 3 moving to the right mating position while the sidewall 205 of the plug housing 20 abuts against a corresponding lateral side of the receptacle housing 30 for the similar reason. Then, the expending contact portions 221, 231 of the conductors 21 beyond the mating face 202 of the housing 20 are aligned with openings formed on the mating face 301 of the receptacle housing 30 leading to the passageways so as to be inserted into the passageways 302 respectively and finally engage with the receptacle conductors 31, 32 installed therein for establishing electrical transmission paths.

Obviously, the identical first conductors 31 and second conductor 32 of the receptacle connector 3 have the same resistance property when power current pass through them. However, the resistance of the first and second conductors 22, 23 of the plug connector 2 follow the formula stated as below:

$$R=\rho L/A$$

wherein R means resistance of a conductor, ρ is resistivity of the conductor, L is the length of the conductor, and A means the cross sectional area of the conductor. It is understood that the length of the second conductor 23 is longer the one of any first conductor 22, but the cross sectional area of the second conductor 23 is bigger than the one of any first conductor 22 at the same time. Therefore, the resistance of the first and second conductors 22, 23 is controlled to be same by adjusting the length and cross sectional area of the second conductor 23 so that the electrical current passing through the conductors 21 will be uniform and much stable. This makes the whole connector assembly 1 can achieve better electrical performance and adds the facilitation to simplify the structure and use of the connector assembly 1.

Usually, the connector assembly 1 in accordance with the present invention is a part of a backplane connector assembly wherein the plug connector 2 is probably mounted on a daughter board (not shown) by being arranged next to a signal-transmitting connector part, and the receptacle connector 3 is probably mounted on a backplane or motherboard with another signal-transmitting connector part being mated with the former one. Due to the compact size the connector assembly 1 has, the plug connector 2 and receptacle connector 3 of the connector assembly 1 are easy to become modularized or assembled with other backplane connector components or parts.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector assembly comprising:

a first electrical connector having a first housing and a plurality of first conductors installed in the first housing; and a second electrical connector configured to be mated with the first electrical connector and having a second housing mated with the first housing and a plurality of second conductors being installed in the second housing and electrically connecting to corresponding first conductors of the first electrical connector;

at least one of the plurality of the first conductors having installation orientation different from that of some other of the plurality of the first conductors, and the at least one of the plurality of the first conductors having a resistance equal to that of each of said some other of the plurality of the first conductors; wherein said some other of the plurality of the first conductors are arranged in one row and each of said some other of the plurality of the first conductors is located in respective one plane of a first group of parallel-arranged imaginary planes; wherein said at least one of the plurality of the first conductor has a contacting portion located in a second imaginary plane perpendicular to any of the first group of parallel-arranged imaginary planes; wherein said at least one of the plurality of the first conductors is an L-shaped plate and stamped from one metal sheet; wherein said at least one of the plurality of the first conductors has several tail portions extending vertically from the contacting portion thereof and located in a third imaginary plane perpendicular to both the first parallel plane group and the second imaginary plane; wherein the second conductors of the second electrical connector are identically shaped at least one of the plurality of the second conductors is located in the second imaginary plane when the second electrical connector is mated with the first electrical connector.

2. The connector assembly as recited in claim 1, wherein each of said some other of the plurality of the first conductors of the first electrical connector is of a plate-like configuration and defines one imaginary plane of the first parallel plane group.

3. A connector assembly comprising:

a first connector adapted to be mounted upon a first printed circuit board;

a second connector mated with the first connector and adapted to be mounted upon a second printed circuit board perpendicular to said first printed circuit board;

said first connector defining at least a first set of first contact sections and a second set of first contact sections both of an identical configuration and extending straightly toward the second connector while perpendicular to each other;

said second connector defining a first set of second contact sections and a second set of second contact sections, said first set of second contact sections being located closer to the second printed circuit board than the second set of second contact sections;

each of the first set of second contact sections extending in a first plane, and each of said second set of second contact sections extending in successive second and third planes both of which are perpendicular to said first plane; wherein said second plane is parallel to said second printed circuit board said third plane is parallel to said first printed circuit board, and said first plane is perpendicular to both said first printed circuit board and said second printed circuit board; wherein each of the first and the second sets of the first contact sections comprises pairs of contacting portions and a plurality of tail portions opposite to the contacting portions, and wherein each contacting portion of the same pair is bent away from each other; wherein each of the second set of the second contact sections is an L-shaped plate and comprises a top plate section extending in the second plane and a lateral plate section extending in the third plane.

4. The connector assembly as recited in claim 3, wherein each of the first set of the first contact sections extends in the first plane, and each of the second set of the first contact sections extends in the second plane.

5. The connector assembly as recited in claim 3, wherein each of the first set of the second contact sections has a same resistance as each of the second set of the second contact sections.

6. The connector assembly as recited in claim 3, wherein each of the first set of the second contact sections is arranged as an upright plate and comprises a pair of contacting portions spaced by a slot and a plurality of tail portions extending vertically from the contacting portion.

7. The connector assembly as recited in claim 3, wherein each of the second set of the second contact sections comprises a pair of extending contacting portions formed at one end of the top plate section and a plurality of tail portions formed at one end of the lateral plate section.

* * * * *